US006371777B1

(12) United States Patent
Rudoy et al.

(10) Patent No.: US 6,371,777 B1
(45) Date of Patent: Apr. 16, 2002

(54) FLIGHT DISCONNECT CONNECTOR

(75) Inventors: Edward Rudoy, Woodland Hills; Larry Leroy McCormick, Chatsworth; Edwin E. Vega, Woodland Hills; Craig W. Courtney, West Hills, all of CA (US)

(73) Assignee: NEA Electronics, Inc., Chatsworth, CA (US)

( * ) Notice: Subject to any disclaimer, the term of this patent is extended or adjusted under 35 U.S.C. 154(b) by 0 days.

(21) Appl. No.: 09/502,177

(22) Filed: Feb. 10, 2000

(51) Int. Cl.[7] ..... H01R 13/62
(52) U.S. Cl. ..... 439/155; 439/923
(58) Field of Search ..... 439/155, 923, 439/680, 247, 248, 152

(56) References Cited

U.S. PATENT DOCUMENTS 3,063,032 A * 11/1962 Brush ..... 439/155
3,336,562 A * 8/1967 McCormick et al. ..... 439/155
3,360,764 A * 12/1967 Bac ..... 439/155
3,374,457 A * 3/1968 Herrick ..... 439/155
3,497,862 A * 2/1970 Geffner ..... 439/155
4,795,360 A * 1/1989 Newman et al. ..... 439/278
5,383,790 A * 1/1995 Kerek et al. ..... 439/248
5,466,171 A * 11/1995 Bixler et al. ..... 439/680
5,655,916 A * 8/1997 Hayashi ..... 439/155

* cited by examiner

*Primary Examiner*—Brian Sircus
*Assistant Examiner*—Hae Moon Hyeon
(74) *Attorney, Agent, or Firm*—Lewis B. Sternfels

(57) ABSTRACT

A quickly separable and disconnectable electrical connector device (10) comprises a pin section (14) having a socket receptacle (40) and a socket section (16). A mounting flange (18) is mounted about the socket receptacle and is coupled to a supporting structure (26) on the socket section. A force member configured as a ring (32) surrounds the pin engageable end of socket receptacle (40) and is adapted to abut the pin section. An adjustable spring (28) on the socket receptacle urges force member (32) against pin section (14), and is located adjacent to one side of flange (18) for reducing the force required to separate the pin and socket sections from one another and thereby for aiding separation therebetween.

12 Claims, 2 Drawing Sheets

Fig. 3.
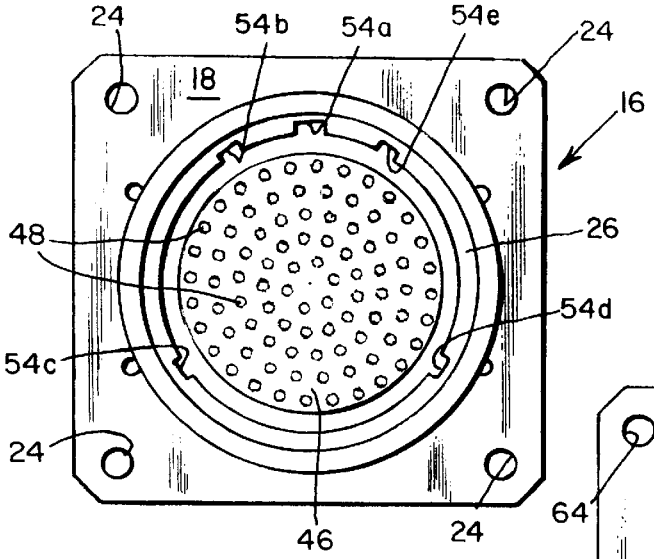
Fig. 4.
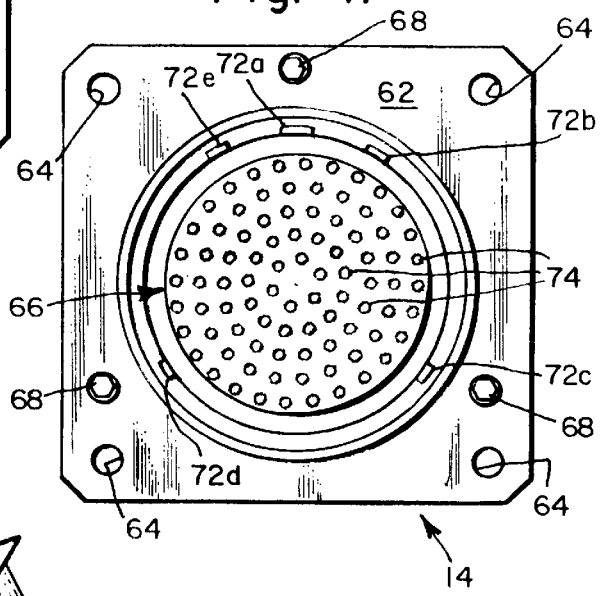
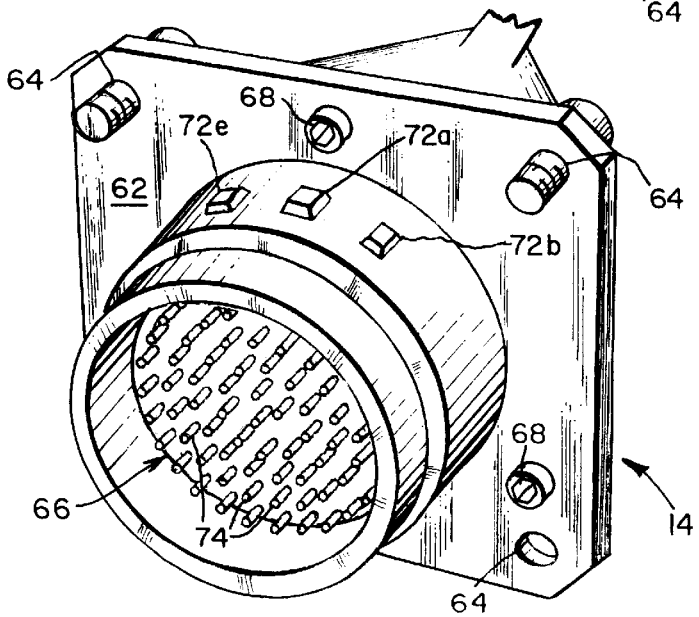
Fig. 5.

FLIGHT DISCONNECT CONNECTOR

TECHNICAL FIELD OF THE INVENTION

The invention relates to pin and socket connector devices for providing a temporary, easily severed, multi-channeled data connection between two objects, such as a satellite and a launch vehicle.

BACKGROUND OF THE INVENTION

In the aerospace industry it is often necessary to provide an electrical data and/or power connection between two structures that can be easily and quickly separated from each other at the proper time (e.g., upon the launch of a satellite or stage separation of a launch vehicle). This typically takes the form of a two-part connection assembly comprising a unit having pins and a unit having a like number of sockets. By way of an example, a satellite may require a 41-pin connection between stages of a launch vehicle (or to an adjoining satellite in a "stacked" configuration) until the moment of release. Such a connector must mate easily, stay in place and then release easily.

Typically in such units, the pin size is standardized to strict military specifications. Conversely, the military standards for sockets allow a wide variety in retention force. Therefore, for each connector to connector assembly, the individual sockets may exert differing amounts of drag against the pins during separation. For instance, in a common configuration in which the sockets average about 1.5 pounds of drag each, there is considerable variation between sockets from that average (perhaps between 4 and 18 ounces of force). Moreover, the force needed to uncouple the 41 sockets in the above example can easily vary between 164 and 738 ounces of force.

Because of the force required to disengage the connector assembly, springs are typically used to counterbalance some of that force. For instance, if a certain pin and socket combination required 78 pounds of force to disengage, a spring exerting 75 pounds of force might be included so that the actual separation force would be an acceptable 3 pounds. This has presented a problem with prior art devices, due to the above-noted variance in the sockets. One solution has been to package the "pin connector" and the "socket connector" as a matched pair, with an adjustment spring on the pin connector. In such devices, the spring tension is factory-adjusted to compensate for the particular socket connector being employed. This has the disadvantage of creating an otherwise-standardized set of pins that mates only with a particular set of sockets.

Another problem with prior art units is that they are prone to misalignment upon initial mating (e.g., when mounting the satellite to the launch vehicle). Because the two connector units are often rigidly attached to their respective parts (one to the launch vehicle, one to the satellite) it is difficult to maneuver the smaller device (the satellite in this example) so that the pins and sockets precisely mesh. Thus it is advantageous to have one of the connectors capable of limited movement to match the orientation of the other connector. One solution that has been employed is the use of spring-loaded adjustable screws which movably mount the connector to the structure. Unfortunately, this has been found to result in a number of problems. First, the user must take great pains to mount the device and properly tighten the screws (too tight and the spring is so compressed that there is no "play". Second, it takes up valuable space in applications where space is scarce (the additional area necessary for the springs increases geometrically with the number of adjustable connectors). Thirdly, to avoid electromagnetic interference, a backshaft is often necessary. Unfortunately, to give the user access to adjust the springs of the spring-loaded screws, a backshaft is not practical.

A further problem with the prior art is that if the pins are rotated even slightly relative to the sockets, the device will either not mate properly or the pin ends may be bent, causing device failure.

What is needed is a pin and socket connector device in which the pin section can be used with a number of socket sections, that allows for some misalignment upon mating, and prevents damage due to rotation of one part relative to another prior to mating, without the above noted problems.

SUMMARY OF THE INVENTION

In a first embodiment, the present invention provides a quickly separable and disconnectable electrical connector device for transmitting a plurality of electrical signals between a first station having a first signal source and a second station having a second signal source. A pin section is electrically connectable to the first signal source at the first station. A socket section is electrically connectable to the second signal source at the second station. The pin section includes a housing which supports a plurality of pins held within a pin receiving body or pin shaft. The socket section includes a housing which supports a plurality of sockets pins held within a socket receiving body or socket shaft. The sockets are adapted to receive the pins in an electrically conductive relationship. A force member, preferably embodied as a ring integral with the socket section housing, surrounds the pin engaging end of the socket shaft (socket receiving body) for applying an ejection force against the pin section. An adjustable spring on the socket shaft urges the force member or ring against the pin section. When the pin section is urged against the socket section with a force sufficient to overcome the adjustable spring, the pins are inserted to the sockets to complete the electrical connection therebetween, and the force needed to separate the pin section from the socket section is reduced by the force of the adjustable spring bearing against the pin section.

In a second embodiment, the pin shaft or pin receiving body further comprises at least one raised key and the socket shaft or socket receiving body further comprises at least one charnfer for receiving at least the one raised key, to prevent misalignment of the socket section with the pin section. A force member surrounds the pin engaging end of the socket shaft and is disposed to abut against the pin section.

In a third embodiment, the socket shaft extends through an aperture in a mounting flange which is coupled to the second station. An alignment spring, located on the socket shaft, bears against the mounting flange. The aperture is sized to be larger than the socket shaft to allow movement of the socket shaft, as restrained by the alignment spring.

In other embodiments, the adjustable spring is a compression spring which bears against the force member at one end, and an adjustment means at the other end of the adjustable spring varies the force exerted by the adjustment spring against the force member. The socket shaft further comprises a threaded portion and the adjustment means is a threaded nut wherein the adjustment means engages the threaded portion of the socket shaft and the adjustable spring may be adjusted by rotating the adjustment means about the socket shaft. A socket shaft passes through a flange extending out from both sides, and the alignment spring is located adjacent to the pin side of the mounting flange, and an adjustable spring on the socket shaft urges the force member against the pin section. Here, the adjustable spring is located adjacent to the pin or socket side of the flange and the adjustable spring and the alignment spring are coaxial.

These and other features and advantages of this invention will become further apparent from the detailed description and accompanying figures that follow. In the figures and description, numerals indicate the various features of the invention, like numerals referring to like features throughout both the drawings and the description.

BRIEF DESCRIPTION OF THE DRAWINGS

FIG. 3 is a top plan view of the socket section (16) of the present invention.

FIG. 4, is an isometric view of the pin section (14) of the present invention.

FIG. 5 is a top plan view of the pin section (14) of the present invention.

DETAILED DESCRIPTION OF THE PREFERRED EMBODIMENT

Figure 1:
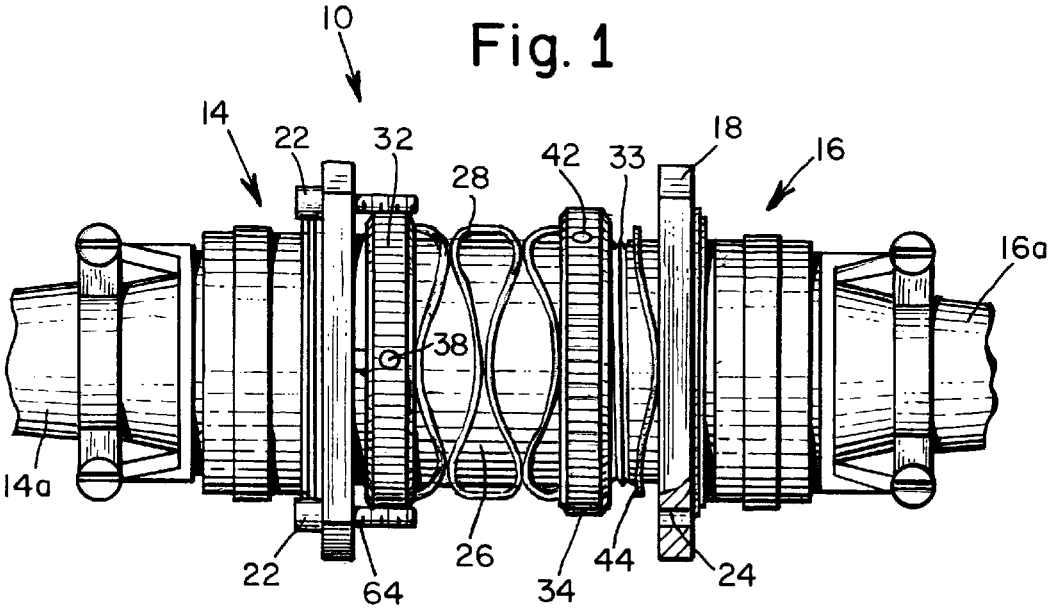
FIG. 1 is an isometric view of the In Flight Disconnect connector constructed according to the present invention.
Figure 1A:
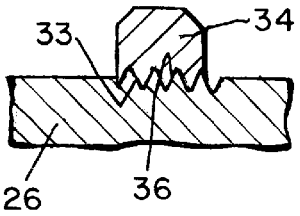
FIG. 1*a* is a view taken along line 1*a*—1*a* of FIG. 1.

FIG. 1 shows a mated connector 10 constructed according to the present invention. The mated connector 10 includes a pin section 14 and a socket section 16.

In typical aerospace applications, either the pin section 14 or the socket section 16 may be connected to a lunch vehicle structure (not shown), with the other section connected to a release object (not shown). In the preferred embodiment shown, the socket section 16 is connected to the lunch vehicle structure. Pin section 14 is coupled to a first station, having a first signal source, by a cable assembly 14*a*. Socket section 16 is coupled to a second station, having a second signal source, by a cable assembly 16*a*.

The socket section 16 (see also FIG. 2) includes a mounting flange 18 for mounting the socket section 16 to a structure such as a lunch vehicle or release object. The mounting flange 18 may be attached in any number of ways, such as welding or bolting; however it has been found that four attachment screws, such as attachment screw 22, provides satisfactory results. In a preferred embodiment, four attachment apertures 24 are also provided to receive the four attachment screws 22. The socket section 16 has a central plug housing 26 which passes through a central aperture (not shown) in the mounting flange 18.

The socket section 16 has an adjustable spring 28 which provides a force pulling against the drag created by the mating of the pin section 14 and the socket section 16, as discussed below. The adjustable spring 28 is a compression spring, in a preferred embodiment rated at 60–70 pounds, which is resisted on one end by a front mating ring or force member 32, and on the other end by an adjustment ring 34. The front mating ring 32 is capable of moving laterally along the central plug housing 26, over a distance of about 3/16 inch in a preferred embodiment. This lateral movement is allowed and restrained by one or more pins, such as pin 38 in the front mating ring 32, which rides in a lateral groove (not shown) in the central plug housing 26 beginning about 1/8 inch from the front mating ring end of the central plug housing 26 and extending towards the mounting flange 18 for a distance of about 3/16 inch. In a preferred embodiment, three pins evenly spaced around the front mating ring 32 and three corresponding grooves in the central plug housing 26 are provided. As depicted in FIG. 1, housing 26 is provided with external threads 33.

The adjustment ring 34 has a threaded interior 36 (not shown) which are threaded along corresponding threads 33 in the central plug housing 26. In other embodiments, the adjustment ring 34 may not be threaded, but rather use a cam, detent, set screws, or other means with a locking mechanism to adjust and set the tension on the adjustment spring 28. In a preferred embodiment, the adjustable spring 28 may be compressed or released by turning the adjustment ring 34. A locking pin 42 is provided for locking the adjustment ring 34 in place, once it is threaded to the desired position (i.e., compressing the adjustable spring 28 so that the desired amount of force is exerted against the front mating ring or force member 32).

The socket section 16 also has an alignment spring 44, for compensating for misalignment of the socket section 16 and pin section 14 during mating. In a preferred embodiment, the alignment spring 44 is a compression spring rated at about 60 pounds, which is resisted at one end by the mounting flange 18 and at the other end by the adjustment ring 34. Although in this preferred embodiment the alignment spring 44 is shown on the same side of the mounting flange 18 as the adjustment spring 28, in other embodiments the alignment spring 44 may be on the opposite side of the mounting flange 18. In a preferred embodiment, the diameter of the aperture (not shown) in the mounting flange 18 is slightly larger than that of the central plug housing 26, such that a slight amount of "play"=0 may be encountered. The alignment spring 44 as well as the adjustment spring 28 provide additional force when mounting the pin section 14 into the socket section 16. For instance, in an embodiment suitable for aerospace applications, the central plug housing 26 has a diameter between about 3/4 and 2.0 inches, while the aperture has a diameter between about 13/16 and 2 1/16 inches. In such an embodiment, the mounting flange 18 will be attached to the structure, while the pin section 14 will be attached to the release load. Should any misalignment occur on mating, the socket section 16 will have some "play" in that it can swivel about the aperture in the mounting flange 18 enough to accommodate minor misalignment.

Figure 2:
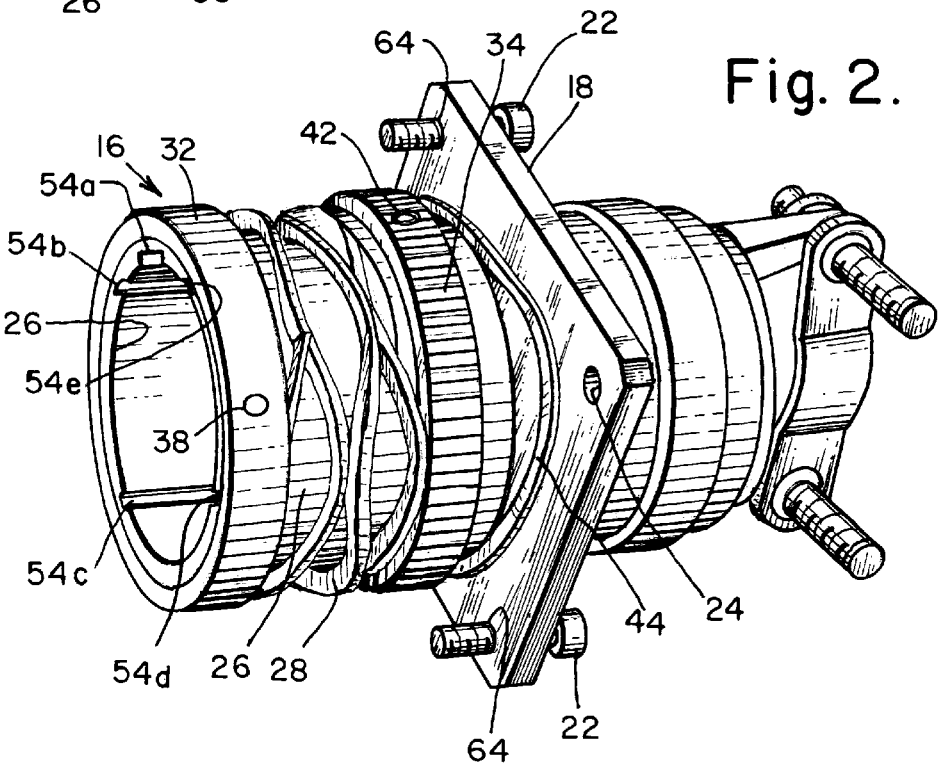
FIG. 2 is an isometric view of the socket section (16) of the present invention.

FIG. 3 shows the socket section 16 schematically depicted, showing the attachment apertures 24, mounting flange 18, front mating ring 32, and central plug housing 26 also shown in FIGS. 1 & 2. The socket section 16 has a socket shaft or socket retaining body 40, a socket surface 46, which is essentially a raised platform 52 having a plurality of socket apertures 48 which each contain an individual electrical contact (not shown). The central plug housing 26 forms a wall surrounding the raised platform 52 with approximately 1/82 inch of space between the socket surface 46 and the central plug housing 26. In a preferred embodiment, the central plug housing 26 extends approximately 3/4 inch above the mounting flange 18, while the socket surface 46 extends only approximately 1/4 inch above the mounting flange 18. The space thus formed is designed to receive the pin section 14 (see FIGS. 4–5). The central plug housing 26 defines one or more chamfers, such as master chamfer 54-*a* and chamfers 54-*b*, 54-*c*, and 54-*d* and 54-*e*. To insure proper mating orientation, master chamfer 54-*a* is larger than chamfers 54-*b*, 54-*c*, and 54-*d* and 54-*e*. As discussed below, these will receive mating keys from the pin section 14.

The pin section 14 includes a pin mounting flange 62 for mounting the pin section 14 to a structure such as a launch vehicle or release object (in a preferred embodiment, the pin section 14 will be mounted to a release object). The pin mounting flange 62 may be attached in any number of ways such as welding or bolting; however it has been found that four attachment screws (not shown) provide satisfactory results. Thus in a preferred embodiment, four attachment apertures 64 are provided through which bolts (not shown) may be used to attach the pin section 14 to a structure. The pin section 14 has a pin central shaft or pin receiving body 66 which passes through a central aperture (not shown) in the pin mounting flange 62. Standoffs, such as standoffs 68, are mounted to the pin mounting flange 62 and provide reactive surfaces for the front mating ring or force member 32 of the socket section 16. In a preferred embodiment, the pin central shaft 66 extends about one inch from the pin mounting flange 62, and the standoffs 68 extend about ⅛ inch from the pin mounting flange 62.

The pin central shaft 66 includes one or more keys (in a preferred embodiment, five keys are provided), such as master key 72-*a*and keys 72-*b*, 72-*c*, 72-*d*, & 72-*e*. The keys are all of approximately the same size, except for master key 72-*a* which is larger than the others. To prevent misalignment in mating, master key 72-*a* will fit into master chamfer 54-*a* making certain that the orientation of the pin section 14 and the socket section 16 are correct relative to each other. In alternative embodiments (not shown), the keys may be positioned on the central plug housing 26 and the chamfers on the pin central shaft 66.

The pin section 14 also has a plurality of pins 74, the number of which will match the number of sockets in the socket surface 46. In an embodiment suitable for aerospace use, 41 pins and sockets is one of many standard pin and socket configurations.

In operation, the user or manufacturer will first adjust the pressure on adjustable spring 28 for the standard military pin specification by turning the adjustment ring 34 until the needed counter-force is achieved. The pin section 14 and socket section 16 will then be attached and wired to their respective structures. Then the socket section 16 may be installed in a launch or release object, with the ability to receive and mate with any pin section meeting the same release force specifications. The launch structure and release object may now be mated. Any minor misalignment will be compensated for by the "play" allowed by the alignment spring 44. Rotational alignment will be insured by the master key 72-*a* and keys 72-*b*, 72-*c* and 72-*d* mating with master chamfer 54-*a* and chamfers 54-*b*, 54-*c*, and 54-*d*, respectively. Friction of the pins within the sockets will hold the mated connector 10 in the mated condition until release. For example, in a standard aerospace application, a 41 pin connection will exert about 20 pounds of drag. The adjustable spring 28 will be set for about 15 pounds of force, reducing the required separation force to about 5 pounds.

Having now described the invention in accordance with the requirements of the patent statutes, those skilled in the art will understand how to make changes and modifications in the present invention to meet their specific requirements or conditions. Such changes and modifications may be made without departing from the scope and spirit of the invention as set forth in the following claims.

What is claimed is:

1. A quickly separable and disconnectable electrical connector device for transmitting a plurality of electrical signals between a first station having a first signal source and a second station having a second signal source, said connector device comprising:

a pin section electrically connectable to said first signal source and having:

a pin shaft having a socket engageable end and a first station end, said first station end being connectable to said first station;

a plurality of pins, located within said pin shaft, said pins being accessible from said socket engageable end and electrically connectable to said first signal source;

a socket section electrically connectable to said second signal source and having:

a socket shaft having a pin engageable end and a second station end, said second station end being connectable to said second station;

a plurality of sockets, located within said socket shaft, said sockets being accessible from said pin engageable end and electrically connectable to said second signal source, and said sockets being configured to enable reception of said pins in an electrically conductive relationship;

a force member surrounding the pin engageable end of the socket shaft for applying ejection force against the pin section; and an adjustable spring on said socket shaft urging said force member against said pin section;

wherein, when said pin section is urged against said socket section with force sufficient to overcome said adjustable spring, the pins are inserted to the sockets completing the electrical connection therebetween, and the force needed to separate the pin section from the socket section is reduced by the force of said adjustable spring bearing against said pin section.

2. A quickly separable and disconnectable electrical connector device for transmitting a plurality of electrical signals between a first station having a first signal source and a second station having a second signal source, said connector device comprising:

a pin section electrically connectable to said first signal source and having:

a pin shaft having a socket engageable end and a first station end, said first station end being connectable to said first station;

a plurality of pins, located within said pin shaft, said pins being accessible from said socket engageable end and electrically connectable to said first signal source;

a socket section electrically connectable to said second signal source and having:

a socket shaft having a pin engageable end and a second station end, said second station end being connectable to said second station;

a plurality of sockets, located within said socket shaft, said sockets being accessible from said pin engageable end and electrically connectable to said second signal source, and said sockets being configured to enable reception of said pins in an electrically conductive relationship;

a force member surrounding the pin engageable end of the socket shaft for applying ejection force against the pin section; and an adjustable spring on said socket shaft urging said force member against said pin section, said adjustable spring comprising a compression spring bearing against said force member at one end;

an adjustment means at the other end of said adjustable spring for varying the force exerted by said adjustment spring against said force member;

wherein, when said pin section is urged against said socket section with force sufficient to overcome said adjustable spring, the pins are inserted to the sockets completing the electrical connection therebetween, and the force needed to separate the pin section from the socket section is reduced by the force of said adjustable spring bearing against said pin section.

3. The quickly separable and disconnectable electrical connector device of claim 2 wherein said socket shaft further comprises a threaded portion and said adjustment means comprises a threaded nut, wherein said adjustment means engages said threaded portion of said socket shaft and said adjustable spring may be adjusted by rotating said adjustment means about said socket shaft.

4. A quickly separable and disconnectable electrical connector device for transmitting a plurality of electrical signals between a first station having a first signal source and a second station having a second signal source, said connector device comprising:

a pin section electrically connectable to said first signal source and having:

a pin shaft having a socket engageable end and a first station end, said first station end being connectable to said first station;

a plurality of pins, located within said pin shaft, said pins being accessible from said socket engageable end and electrically connectable to said first signal source;

a socket section electrically connectable to said second signal source and having:

a socket shaft having a pin engageable end and a second station end, said second station end being connectable to said second station;

a plurality of sockets, located within said socket shaft, said sockets being accessible from said pin engageable end and electrically connected to said second signal source, and said sockets being configured to enable reception of said pins in an electrically conductive relationship;

a mounting flange disposed about said socket shaft and coupled to a supporting structure;

a force member surrounding said pin engageable end of said socket shaft for abutting said pin section;

an adjustable spring on said socket shaft urging said force member against said pin section, said adjustable spring being located adjacent to one side of said flange for reducing the force required to separate said pin and socket sections from one another and thereby for aiding separation therebetween; and said pin shaft further comprises at least one raised key and said socket shaft further comprises at least one chamfer for receiving said at least one raised key, to prevent misalignment of said socket section with said pin section.

5. A quickly separable and disconnectable electrical connector device for transmitting a plurality of electrical signals between a first station having a first signal source and a second station having a second signal source, said connector device comprising:

a pin section electrically connected to said first signal source and having:

a pin shaft having a socket engageable end and a first station end, said first station end connectable to said first station;

a plurality of pins, located within said pin shaft, said pins being accessible from said socket engageable end and electrically connectable to said first signal source;

a socket section electrically connectable to said second signal source and having:

a socket shaft having a pin engageable end and a second station end, said second station end being connectable to said second station;

a plurality of sockets, located within said socket shaft, said sockets being accessible from said pin engageable end and electrically connectable to said second signal source, and said sockets being configured to enable reception of said pins in an electrically conductive relationship;

a mounting flange disposed about said socket shaft and coupled to a supporting structure;

a force member surrounding said pin engageable end of said socket shaft for abutting said pin section;

an adjustable spring on said socket shaft urging said force member against said pin section, said adjustable spring being located adjacent to one side of said flange for reducing the force required to separate said pin and socket sections from one another and thereby for aiding separation therebetween; and said socket shaft further comprises at least one raised key and said pin shaft further comprises at least one chamfer for receiving said at least one raised key, to prevent misalignment of said socket section with said pin section.

6. The quickly separable and disconnectable electrical connector device of claim 5 wherein said at least one raised key comprises at least two raised keys and said at least one chamfer comprises at least two chamfers corresponding to said at least two raised keys.

7. A quickly separable and disconnectable electrical connector device for transmitting a plurality of electrical signals between a first station having a first signal source and a second station having a second signal source, said connector device comprising:

a pin section electrically connected to said first signal source and having:

a pin shaft having a socket engageable end and a first station end, said first station end connectable to said first station;

a plurality of pins, located within said pin shaft, said pins being accessible from said socket engageable end and electrically connectable to said first signal source;

a socket section electrically connectable to said second signal source and having:

a socket shaft having a pin engageable end and a second station end, said second station end being connectable to said second station;

a plurality of sockets, located within said socket shaft, said sockets being accessible from said pin engageable end and electrically connectable to said second signal source, and said sockets being configured to enable reception of said pins in an electrically conductive relationship;

a mounting flange disposed about said socket shaft and coupled to a supporting structure;

a force member surrounding the pin engageable end of the socket shaft for abutting the pin section;

an adjustable spring on said socket shaft urging said force member against said pin section, said adjustable spring being located adjacent to the pin side of said flange for aiding separation between said pin and socket sections; and said socket shaft further comprises at least two raised keys and said pin shaft further comprises at least two chamfers which correspond to and are disposed to receive said at least two raised keys, to prevent misalignment of said socket section with said pin section, wherein one of said raised keys is differently sized from the remaining raised keys, one of said chamfers is differently sized from the remaining chamfers, and said differently sized chamfer is configured to enable reception of said differently sized raised key.

8. A quickly separable and disconnectable electrical connector device for transmitting a plurality of electrical signals between a first station having a first signal source and a second station having a second signal source, said connector device comprising:

a pin section electrically connected to said first signal source and having:

a pin shaft having a socket engageable end and a first station engageable end, said first station engageable end being connectable to said first station;

a plurality of pins, located within said pin shaft, said pins being accessible from said socket engageable end and electrically connectable to said first signal source;

a socket section electrically connected to said second signal source and having:

a socket shaft having a pin engageable end and a second station engageable end, said second station engageable end being connectable to said second station; and a plurality of sockets, located within said socket shaft, said sockets being accessible from said pin engageable end and electrically connectable to said second signal source, and said sockets being configured to enable reception of said pins in an electrically conductive relationship;

said socket section further comprising:

a mounting flange defining an aperture surrounding the socket shaft and having a means for mounting said mounting flange to said second station, said socket shaft passing though said aperture; and an alignment spring located on said socket shaft and bearing against said mounting flange;

wherein the aperture is larger than the socket shaft to allow movement of the support shaft as restrained by the alignment spring.

9. The quickly separable and disconnectable electrical connector device of claim 8 wherein the mounting flange has two sides, a pin side and a second station side, with the socket shaft passing through the flange and extending out from both sides, and the alignment spring being located adjacent to the pin side of the mounting flange, said socket section further comprising:

a force member surrounding the pin engageable end of the socket shaft for abutting the pin section; and an adjustable spring on said socket shaft urging the force member against said pin section, the adjustable spring being located adjacent to the pin side of the flange; wherein the adjustable spring and the alignment spring are coaxial.

10. The quickly separable and disconnectable electrical connector device of claim 8 wherein the mounting flange has two sides, a pin side and a second station side, with the socket shaft passing through the flange and extending out from both sides, and the alignment spring being located adjacent to the second station side of the mounting flange, said socket section further comprising:

a force member surrounding the pin engageable end of the socket shaft for abutting the pin section; and an adjustable spring on said socket shaft urging the force member against said pin section, the adjustable spring being located adjacent to the pin side of the flange;

wherein the adjustable spring and the alignment spring are coaxial.

11. The quickly separable and disconnectable electrical connector device of claim 4 wherein said at least one raised key comprises at least two raised keys and said at least one chamfer comprises at least two chamfers corresponding to said at least two raised keys.

12. A quickly separable and disconnectable electrical connector device comprising:

a pin section including a plurality of pin contacts located within a pin receptacle having a socket engageable end;

a socket section including a plurality of socket contacts located within a socket receptacle and configured to enable reception of said pin contacts in an electrically conductive relationship therebetween;

a mounting flange mounted about said socket receptacle and coupled to a supporting structure;

a force member surrounding said pin engageable end of said socket receptacle and adapted to abut said pin section;

an adjustable spring on said socket receptacle urging said force member against said pin section, said adjustable spring being located adjacent to one side of said flange for reducing the force required to separate said pin and socket sections from one another and thereby for aiding separation therebetween.

* * * * *